United States Patent [19]

Kaneko

[11] Patent Number: 4,788,362

[45] Date of Patent: Nov. 29, 1988

[54] LIQUID LUBRICANT MIXTURE COMPOSITE

[76] Inventor: Kazuo Kaneko, 865 Shukugawara Tama-ku, Kawasaki-shi, Kanagawa, Japan

[21] Appl. No.: 102,688

[22] Filed: Sep. 30, 1987

[30] Foreign Application Priority Data

Oct. 3, 1986 [JP] Japan ..... 61-236008

[51] Int. Cl.[4] ..... C10M 143/06

[52] U.S. Cl. ..... 585/10; 585/13

[58] Field of Search ..... 585/10, 13

[56] References Cited

U.S. PATENT DOCUMENTS

| | | | |
|---|---|---|---|
| 3,838,049 | 9/1974 | Souillard et al. | 585/10 |
| 4,075,113 | 2/1978 | Van Doorne | 585/13 |
| 4,110,233 | 8/1978 | Bailey et al. | 585/10 |
| 4,481,122 | 11/1984 | Root et al. | 585/10 |

*Primary Examiner*—Jacqueline V. Howard

*Attorney, Agent, or Firm*—Armstrong, Nikaido, Marmelstein & Kubovcik

[57] ABSTRACT

A liquid lubricant oil mixture comprising an oil solution of polyisobutylene having a viscosity average molecular weight (Flory) in the range of 350,000 to 2,100,000, said oil solution being in a concentration in the range of 10 to 90 wt %, and a liquid lubricant oil which contain an additive.

4 Claims, 2 Drawing Sheets

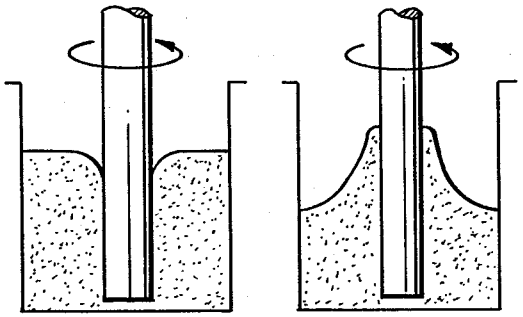
FIG. 2(1)
FIG. 2(2)
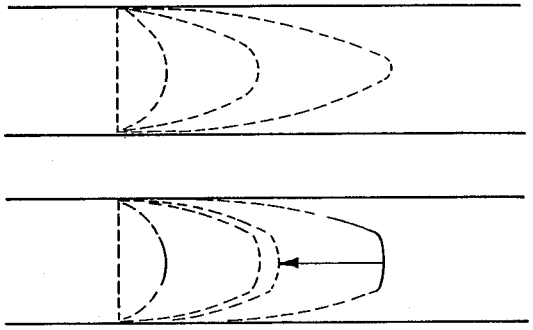
FIG. 1(1)
FIG. 1(2)
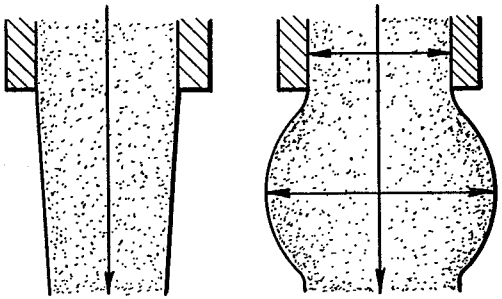
FIG. 3(1)
FIG. 3(2)

LIQUID LUBRICANT MIXTURE COMPOSITE

BACKGROUND OF THE INVENTION

This invention relates to internal combustion engine oil, operation oil, gear oil and various mechanical lubricant oil composites.

It is desirable for a lubricant oil for practical purposes that the viscosity will not vary over a wide range of from low to high temperature. Ordinarily, viscosity index (hereinafter referred to as VI) is used to show the viscosity/temperature relationship of a lubricant. It is said that VI for petroleum lubricant produced through economical methods such as a solvent refining method is, at best, above 100 except for those produced through special refining methods described in Japanese patent publication No. 50-16803. An additive is needed to obtain a lubricant oil having a higher VI. The additive for this purpose is a viscosity index improver, and an oil-soluble polymer compound having a molecular weight of 10,000 or more is ordinarily used.

There are various types of viscosity index improvers and among those used most widely at present are, polymethacrylate and an ethylenepropylene copolymer (generally called olefin copolymer or OCP). Since a polymer is generally solid, these are generally viscous oil solutions having a concentration of 10–80% so that they can be solubilized by oil.

The most important application of the present viscosity index improver (hereinafter referred to as VI-I=VI improver) is to produce multi-grade engine oil for internal combustion engines. The various types of VI-I are shown in Table 6. It has been, however, used for various purposes such as, in the field of hydraulic oil, as an additive for hydraulic oil in the airline industry, automatic transmission oil (ATF) and shock absorber oil or, in the field of operational oil, as numerical control (NC) machine tool oil which requires an excellent viscosity-temperature relationship. Further, in the field of gear oil, multi-grade oil is required for the purpose of low-temperature shift performance or oil consumption improvement and products having viscosity grades of 80W-90 or 75W-90 have been used.

In the prior lubricant oil for gears, driving chains etc, the higher the speed becomes the more the lubricant oil tends to move apart from the lubricant surface and also the more the oil film tends to detach and scatter. Also, it is required to increase the viscosity of lubricant oil in order to improve the sealing effect of an engine to increase its compression and to decrease blow-by gas. However, this results in loss of power because of resistance due to viscosity. Moreover, it is difficult to keep the oil film for a long period of time and wearing out due to dry start was inevitable.

BRIEF SUMMARY OF THE INVENTION

The present invention has been developed in light of the above problems. It is produced by a composite process comprising the steps of mixing the above polymer VI-I and an oil solution of a polyisobutylene having a certain range of viscosity average molecular weight and mixing the mixture with liquid lubricant-oil or its base oil (hereinafter referred to as base oil) at a certain range of ratio thereby making the fluid-dynamic character of the resultant mixture as a non-Newtonian elastic liquid in order to obtain various effects caused thereby.

Liquid lubricant oil mixture composite of the present invention is composed of base oil or liquid lubricant oil which contains additives, 80 or less weight percent of polymer viscosity index improver and 90 or less weight percent of an oil solution of polyisobutylene of a viscosity average molecular weight (Flory) of 350,000–2,100,000. Further, the present invention is composed of a base oil or an additive-containing liquid lubricant-oil and 90 or less weight percent of an oil solution of a polyisobutylene or viscosity average molecular weight (Flory) 350,000–2,100,000. The most preferable viscosity average molecularly weight is shown in Table 6. Because of the above composition of the composite of the present invention, it has advantages such as providing good fuel consumption in internal combustion engines, increasing of power, purification of exhaust gas, reduction of wear, reduction of lubricant oil consumption and extension of durability of oil. The additives are detergent, anti-wear agent, pressure agent, anti-rust agent, corrosion inhibit, anti-foaming agent, anti-oxidant, pour-point depressant etc.

BRIEF DESCRIPTION OF THE DRAWINGS

FIGS. 1, 2 and 3 show various behavior characteristics of non-Newtonian visco-elastic fluid.

DESCRIPTION OF PREFERRED EMBODIMENTS

Figure 4:
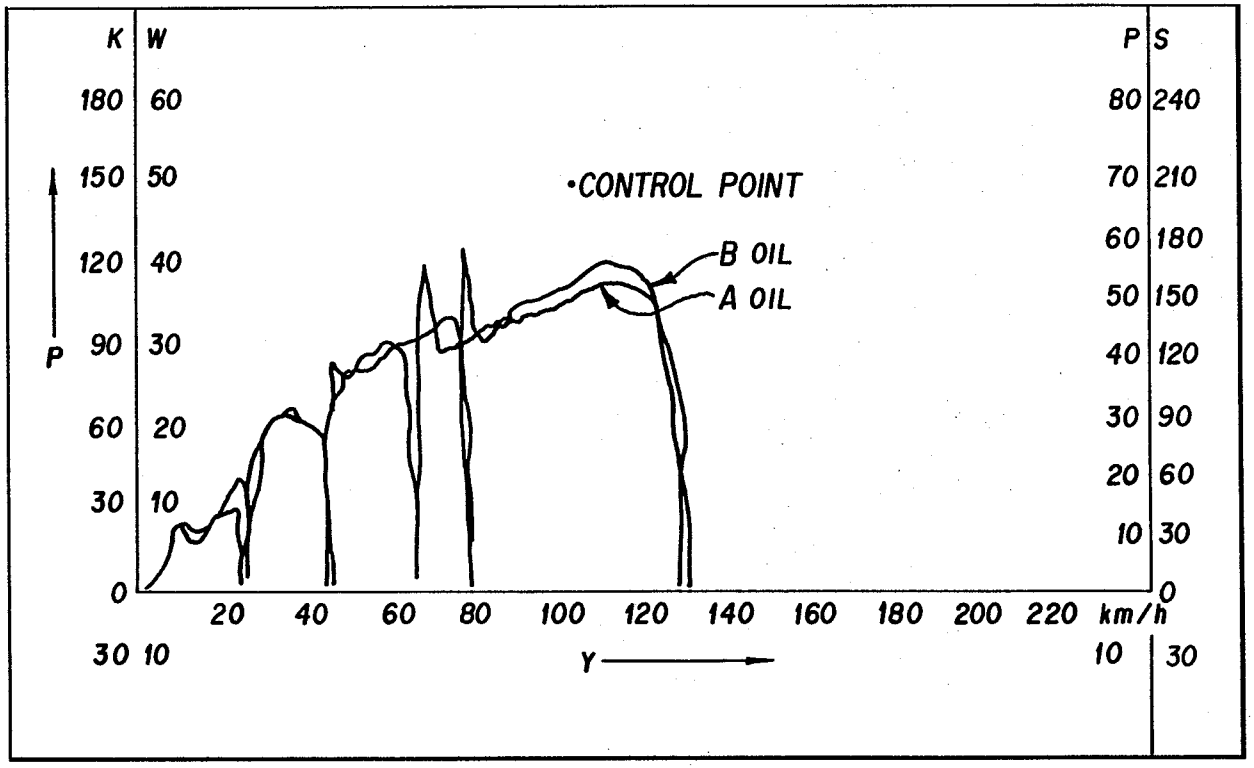
FIG. 4, shows the output power test of A oil and B oil.

Liquid lubricant-oil composite of the present invention is explained hereinafter by the preferred embodiments.

Polyisobutylene (hereinafter referred to as PIB) used in the invention has, different from the polymer used as VI-I, a viscosity average molecular weight (Flory) of 350,000–2,100,000. PIB is obtained by cationic polymerization of isobutylene under a low temperature of about −100° C. using catalysts such as $AlCl_3$ or $BF_3$. It is a polymer of an aliphatic hydrocarbon of high saturation and is composed of long straight chain molecules having an unsaturated group at the end thereof. Due to the structure, PIB is, although soluble in a hydrocarbon solvent, relatively chemically stable and of excellent chemical resistance and oxidation resistance.

The structural formula of PIB used in the present invention is shown in Table 1. PIB used here is a viscous oil solution having a concentration of 10–90% so as to be easily soluble in the base oil.

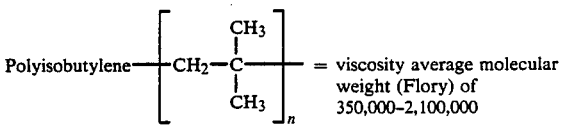

Liquid lubricant-oil composite of the present invention and a mixture of a high concentration of the composite added to a base oil show behavior or typical non-Newtonian elastic fluids. They show, in FIG. 1, rebound effect, in FIG. 2, normal stress effect (or Weisenberg effect or entanglement effect), and, in FIG. 3, Barus effect and others. In the case of dilute solutions thereof, it has an effect to greatly decrease the friction resistance of an object under turbulent flow, which is called Toms effect. In the Figures, 1 is a Newtonian fluid, 2 is visco-elastic fluid. Due to this characteristic fluid behavior, the liquid lubricant composite of the present invention forms a strong lubricant film upon the lubricant surface for a long period of time. For internal combustion engines, the sealing effect is increased, combustion is improved by increased compression and blow-by gas is suppressed. Furthermore, because of a strong oil film and long-time oil film preservation, it will suppress the initial wear, which is said to constitute 90% or more of the wear of the internal combustion engine, and wear under normal operation.

Although it forms a strong oil film, because it is a non-Newtonian visco-elastic fluid, viscosity resistance torque is reduced during operation. Because of this, in the internal combustion engines, there are various effects such as improvement of gasoline consumption, purification of exhaust gas, reduction of wear, increase of output and suppression of deterioration of lubricant oil.

In the field of operation oil, gear oil and general machine oil, there are effects such as reduction of wear, preventing seizing and reduction of gasoline consumption and power consumption.

In order to produce commercial products therefrom, various additives such as cleansing dispersant, anti-oxidant, pour point reduction agent, oiliness improver, anti-corrosive agent, heat stabilizer, shear stabilizer, acid scavenger, wear preventer and others can be added.

Show hereinafter are the data of the effects of the liquid lubricant composite of the present invention.

EMBODIMENT 1

Experiment was conducted on gasoline consumption and exhaust gas using a composite made by mixing 30 weight percent polymer viscosity index improver and 20 weight percent of oil solution of polyisobutylene having a viscosity average molecular weight (Flory) of 990,000–2,100,000.

(1) Results of gasoline consumption and exhaust gas test of the liquid lubricant composite of the present invention using chassis dynamometer 1. Test items
   a. Gasoline consumption by 10-mode running test
   b. Exhaust gas during 10-mode running
   c. Gasoline consumption under uniform load, uniform time and uniform speed.
2. Test method
   a. All tests were conducted by chassis dynamometer Type used: Eddy-current electric dynamometer (BCD-100E)
   b. At first, above tests were conducted on commercial A oil (10W-30, SD grade). Next, same tests were conducted on B oil made by adding liquid lubricant composite of the present invention into the A oil. These test results were compared.
3. Vehicles used in the test
   a. A vehicle
      2,000 cc, four doors, automatic, 1979 made, and total running distance 11,000 Km.
   b. B vehicle
      1,800 cc, two doors, HT EGI, 1955 made, manual transmission, and total running distance 34,000 Km.
4. Test results
   Test results are shown in Tables 2, 3 and 4, wherein Table 2 shows gasoline consumption of 10-mode running by chassis dynamometer, Table 3 shows exhaust gas data and Table 4 show fuel consumption under uniform load and uniform speed.

TABLE 2

| | fuel consumption test | | | |
|---|---|---|---|---|
| | A vehicle | | B vehicle | |
| | A oil | B oil | A oil | B oil |
| fuel consumption according to exhaust gas ingredients | 11.29 km/L | 12.046 km/L | — | — |
| Fuel consumption improvement owing to B oil | +6.67% | | — | |
| Fuel consumption measured by fuel meter during 10-mode running | | | | |
| running distance | 3.307 km | 3.300 km | 3.328 km | 3.313 km |
| Fuel consumption | 0.33 L | 0.31 L | 0.32 L | 0.30 L |
| Fuel consumption rate | 10.02 km/L | 10.64 km/L | 10.40 km/L | 11.04 km/L |
| Fuel consumption improvement owing to B oil | +6.18% | | +6.15% | |

TABLE 3

| | Exhaust gas test | | |
|---|---|---|---|
| | A vehichle (Brand new) | | |
| | A oil | B oil | effects by B oil |
| Sample quantity (m) | 48.88 | 48.99 | — |
| running distance (km) | 3.307 | 3.30 | — |
| CO concentration (ppm) | 4.8 | 2.1 | −56.3% |
| HC concentration (ppm) | 4.1 | 2.0 | −51.2% |
| NO concentration (ppm) | 1.2 | 1.06 | −11.7% |
| CO quantity (g/km) | 0.083 | 0.037 | −55.4% |
| HC quantity (g/km) | 0.035 | 0.017 | −51.4% |
| NO quantity (g/km) | 0.033 | 0.030 | −9.1% |
| Exhaust gas fuel consumption (km/L) | 11.292 | 12.046 | +6.68% |

TABLE 4

| | Fuel consumption test | | | |
|---|---|---|---|---|
| | B vehicle (Brand new) | | | |
| | A oil | B oil | A oil | B oil |
| Speed (km/h) | 60 | | 100 | |
| gear | 5 speed | | 4 speed | |
| load (kg · f) | 50 ± 0.1 | | 50 ± 0.1 | |
| distance (m) | 10,003 | 10,010 | 10,012 | 10,017 |
| Fuel consumption (L) | 0.77 | 0.73 | 0.87 | 0.80 |
| Fuel consumption rate (km/L | 12.99 | 13.71 | 11.50 | 12.52 |
| Fuel consumption improvement due to B oil | +5.54% | | +8.86% | |
| Speed (km/h) | 60.3–60.4 | 60.2–60.4 | 100–100.5 | 100–100.2 |
| engine rotation (RPM) | 1831–1834 | 1829–1834 | 3675–3681 | 3670 |
| Boost pressure (−mmHg) | −211<br>−208<br>−209<br>−210 | −219<br>−221<br>−221 | −215<br>−217<br>−212 | −236<br>−234<br>−232 |

As is clearly shown by the results, lubricant oil containing liquid lubricant composite of the present invention shows remarkable fuel consumption improvement and purification of exhaust gas as compared to the commercial multi-grade oil and particularly so as to fuel consumption at high speed rather than low speed.

(2) Output power test results of liquid lubricant composite of the present invention by chassis dynamometer 1. Test items
   Engine output power
2. Measuring device
   Chassis dynamometer IPS 002 made by BOSCH Co. West Germany
3. Test methods
   Measured was the output power of the test vehicle containing commercial engine oil, A oil (diesel #30, CD), by setting control point at speed of 100 Km/h.
   Next, same tests were conducted on the vehicle containing B oil made by adding high concentration additive-type of liquid lubricant composite of the present invention into the A oil. Both test results were compared.
4. Vehicle used in the tests
   Diesel car 2,200 cc, 1 Ton, brand new and total running distance: 5,837 Km.
5. Test results
   The test results are shown in FIG. 2. According to the results, it is shown that the improvement of the output power of the engine using B oil containing liquid lubricant composite of the present invention is, as compared to A oil, about 5%. The idling revolution increased by about 4.4% from 690 rpm to 720 rpm.
   By this, it is shown that liquid lubricant composite of the present invention increases the compression of the engine, improves the combustion, increases the output power by suppressing blow-by gas and increases the idling revolution by smoothening the rotation.

EMBODIMENT 2

Using liquid lubricant composite made by adding 10 weight percent of polyisobutylene oil solution having viscosity average molecular weight (Flory) of 990,000–2,100,000 into either base oil or liquid lubricant containing additive. PV test was conducted in order to test the performance particularly pressure resistance and wear resistance of operation oil used in the torque converter for construction vehicle.

Using currently used oil as base oil, various pressure-resistance wear-resistance improving supplement oil is added thereto. Pressure resistance and wear resistance of the resulted oil are examined by a friction tester.

The results are as follows.

1. Oil used
   (1) Base oil
   Diesel engine oil 10W (CO grade)
   (2) Supplement mixture oil
   Below four kinds each made by adding 10% of supplement oil into base oil.
   a. SP 04 pressure-resistance.wear-resistance type supplement
   b. SP 05 B mixture composite additive type oil of the present invention
   c. SP 07 pressure-resistance.wear-resistance type supplement
   d. SP 08 pressure-resistance.wear-resistance type supplement
2. Test machine
   Falex Friction of Wear Testing Machine
   Equipped with testing main body and measuring device, both made by Faville Le Vally Corporation
3. Test condition
   (1) Test piece
   a. rotary ring
   diameter 35 mm
   width 8.15 mm
   hardness HRC 58-63
   roughness 127–380 nm (5–15μ in)
   SAE 01 Tool steel (Timken T54148, test cup 40266)
   b. Fixed block
   width 6.35 mm
   length 15.76 mm
   hardness HRC 30
   surface finish 102–203 nm (4–8μ in)
   SAE 4620 Carbon steel
   (2) Oil immersion
   Test oil charge quantity is about 200 ml. Oil level is up to the upper portion of the fixed block
   (3) Load
   27 Kg. (60 lbs), weight used
   Loading method was such a manner that the weight was previously loaded and revolution commenced until certain rpm.
   (4) Friction portion
   Linear contact test between the rotary ring and the fixed block.
   (5) Revolution 2,000 rpm and 4,000 rpm were conducted.
   In each case, revolution was increased at a rate shown below and each value was digitally read and recorded.
   The increase rate was 500 rpm/30s.
   (6) Test temperature
   Test piece was heated and controlled so as to maintain 100° C.
4. The test results were shown in Table 5.
   (1) The test result using base oil (commercial diesel oil) was as shown in Table 5. At 2,000 rpm it was completed, however, at 4,000 rpm it was seized after 30 seconds.
   In contrast, as to the mixed oil mixed with high concentration additive type oil of lubricant oil mixture composite of the present invention, either at 2,000 rpm or at 4,000 rpm it completed 17 minutes of normal lubrication.
   (2) As compared to commercial base oil, all the ring-weight-change, block-weight-change and block-wear were smaller and particularly at 4,000 rpm there was significant difference.
   (3) As compared to the other test oil, it shows that the test oil of the present invention has remarkable performance in pressure resistance and wear resistance.

TABLE 5

| test number No. | load (lbs) | temperature (°C.) | revolution (RPM) | Friction force (lbs) | test results: test time (min) | Ring weight change (mg) | Block weight change (mg) | Block wear trace width (mg) |
|---|---|---|---|---|---|---|---|---|
| 1 | 60 | 100 | 2,000 | 5.8 | 17 completed | +0.2 | −1.6 | 0.75 |
| 2 | 60 | 100 | 4,000 | 15 | 0.5 not completed | −8.1 | −11.2 | 4.1 |
| 3 | 60 | 100 | 2,000 | 5.1 | 17 completed | ±0.0 | −0.5 | 1.2 |
| 4 | 60 | 100 | 4,000 | 10 | 3 not completed | −30.8 | −1.8 | 2.0 |
| *5 | 60 | 100 | 2,000 | 5.8 | 17 completed | +0.4 | +0.4 | 0.75 |
| *6 | 60 | 100 | 4,000 | 4.1 | 17 completed | −0.1 | +1.0 | 1.2 |
| 7 | 60 | 100 | 2,000 | 5.5 | 17 completed | −0.7 | +1.4 | — |
| 8 | 60 | 100 | 4,000 | 8.7 | 10 not completed | −30.6 | −0.5 | 1.5 |
| 9 | 60 | 100 | 2,000 | 5.8 | 17 completed | −0.3 | +0.6 | 0.8 |
| 10 | 60 | 100 | 4,000 | 12 | 0.5 not completed | −13.7 | −3.6 | 3.0 |

TABLE 6

| Various Types of VI-I | | AMW = Average Molecule Weight |
|---|---|---|
| Polymethacrylate | | |
| Disperse System | 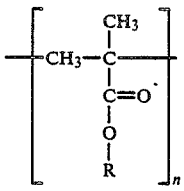 | R = $C_1$–$C_{19}$<br>AMW = 20,000–1,500,000 |
| non disperse system | 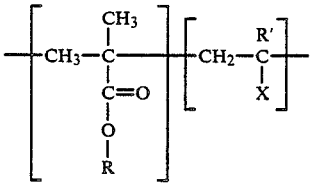 | R = H or $CH_3$<br>X = Radical R and AMW are similar to those of non-disperse type |
| Polyisobutylene | 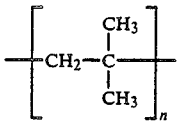 | AMW = 5,000–300,000 |
| Polyalkystyrene | 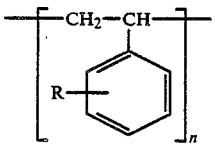 | R = $C_8$–$C_{12}$ |
| Ethyrene - Propylene Copolymer | 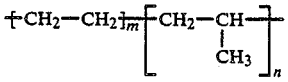 | AMW = 20,000–250,000<br>ethylene 40–60 wt % |
| Styrene - Diene Copolyene hidride (random copolymer or block copolymer) | 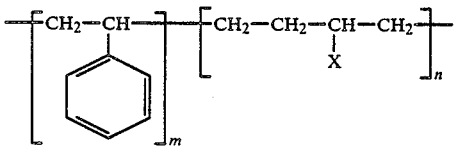 | In case of random copolymer<br>AMW = 20,000–100,000<br>X = H or $CH_3$ diene 30–75 wt |

TABLE 6-continued

| Various Types of VI-I | AMW = Average Molecule Weight |
|---|---|
| Styrene - Maleic ankydride Ester Co-polymer | 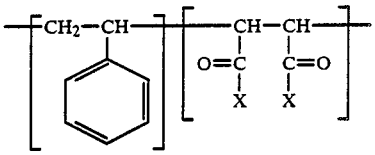 ester, amid, etc. |

ADVANTAGES OF THE PRESENT INVENTION

Due to the structure mentioned above, the present invention has following advantages.

Since said polymer viscosity index improver and an oil solution of polyisobutylene having certain range of said viscosity average molecule weight are mixed together and certain rate of the mixture is added to either liquid lubricant oil or base oil thereof, the fluid dynamic character of the resulted mixture becomes non-Newtonian visco-elastic fluid. Due to the character, it forms strong oil film, improves fuel consumption in the internal combustion engine, increases the output, purifies the exhaust gas, decreases wear, reduces lubricant oil consumption, extends the durability of lubricant oil and has other excellent advantages.

Further, lubricant oil mixed with said oil solution of polyisobutylene alone has also similar advantages and particularly has excellent advantages in improving pressure resistance and wear resistance during high load and high revolution.

What I claim is:

1. A liquid lubricant oil mixture comprising, an oil solution of polyisobutylene having a viscosity average molecular weight (Flory) in the range of 350,000 to 2,100,000, said oil solution being in a concentration in the range of 10 to 90 wt. %, and a liquid lubricant oil which contains an additive.

2. A liquid lubricant oil mixture comprising, an oil solution of polyisobutylene having a viscosity average molecular weight (Flory) in the range of 350,000 to 2,100,000, said oil solution being in a concentration in the range of 10 to 90 wt. %, and a base oil.

3. The liquid lubricant oil mixture of claim 1 which further comprises, a polymer viscosity index improver, said index improver being in a concentration in the range of 10 to 80 wt. %.

4. The liquid lubricant oil mixture of claim 2 which further comprises, a polymer viscosity index improver, said index improver being in a concentration in the range of 10 to 80 wt. %.

* * * * *